United States Patent [19]

Rundell

[11] Patent Number: 4,533,162

[45] Date of Patent: Aug. 6, 1985

[54] STABBING BOX AND SAFETY SLIP FOR MAKING TUBING CONNECTIONS

[75] Inventor: Herbert A. Rundell, Houston, Tex.

[73] Assignee: Texaco Inc., White Plains, N.Y.

[21] Appl. No.: 474,407

[22] Filed: Mar. 11, 1983

[51] Int. Cl.[3] ..... F16L 15/00

[52] U.S. Cl. ..... 285/27; 285/373; 285/140; 166/77.5; 166/242; 166/75.1; 175/320

[58] Field of Search ..... 285/27, 373, 24, 419, 285/140, 142; 166/77.5, 242, 75 R; 175/320

[56] References Cited

U.S. PATENT DOCUMENTS

| | | | |
|---|---|---|---|
| 2,575,831 | 11/1951 | Pearce | 285/29 |
| 3,345,826 | 10/1967 | Hignite | 175/320 X |
| 3,475,038 | 10/1969 | Matherne | 285/27 |
| 3,585,805 | 6/1971 | Vincent | 285/24 X |
| 4,194,765 | 3/1980 | Reddy | 285/27 |

FOREIGN PATENT DOCUMENTS

| | | | |
|---|---|---|---|
| 2499644 | 8/1982 | France | 285/419 |

*Primary Examiner*—Cornelius J. Husar
*Assistant Examiner*—Eric S. Katz
*Attorney, Agent, or Firm*—Robert A. Kulason; Henry C. Dearborn

[57] ABSTRACT

A stabbing box structure that acts as a safety slip. It has a split construction with a clamp to hold it onto the flange of an end connector of a section of tubing which is being supported at the well head by slips. There is a tapered guide interior construction in the box which is for guiding the end connector of another section of tubing that is stabbed into the box. The tube being stabbed is guided into abutting alignment with the end connector that has the stabbing box clamped thereon. The stabbing box has an outside diameter that is greater than the opening at the well head. Consequently, if the slips holding the tubing string already in the well should let go, the stabbing box will prevent the tubing string from falling into the well.

7 Claims, 3 Drawing Figures

STABBING BOX AND SAFETY SLIP FOR MAKING TUBING CONNECTIONS

CROSS REFERENCE TO RELATED APPLICATION

Copending application Ser. No. 510,485 filed July 5, 1983 discloses special coupling for pipe or tubing which is relevant to the subject matter of this application.

FIELD OF THE INVENTION

This invention concerns apparatus for use in deep well operations. More specifically, it concerns a stabbing box structure that is particularly adapted for use with tubing having special end connectors.

BACKGROUND OF THE INVENTION

In oil well operations where use is being made of radio frequency type down hole heating to free heavy petroleum products from certain formations, use has been made of ceramic tubing and the ends of such tubing section have are specially constructed in accordance with the description in the above mentioned copending application. In that type of tubing connectors, the connections of tubing sections are made by means of clamping the connectors together since the operations preclude applying torque for connecting or disconnecting tubing sections. In making up tubing strings using that type of tubing sections, a stabbing box structure has been developed in accordance with this invention. It permits the alignment of tubing sections and holds the connector ends of two tubing sections in place, ready for being clamped together as a string of tubing is made up. Such stabbing box also has the attribute of acting as a safety slip in case the slips holding a tubing string at the well head should let go, so that the tubing string would not be lost downhole.

In the past there have been suggestions of various structures for acting to prevent drill pipe or tubing strings from falling into the hole. However, none of the prior structures known to the applicant have provided any apparatus or structure which was like the applicants stabbing box and safety slip construction. Thus, there is a U.S. Pat. No. 2,575,831 to W. L. Pearce, Nov. 20, 1951 which shows a drill pipe support apparatus that is apparently particularly applicable to the withdrawal of drill pipe strings in an operation using a rotary drilling system. It is not concerned with any stabbing arrangement or operation in connection with making up tubing strings or the like.

There is also a U.S. Pat. No. 3,475,038 to L. Matherne, Oct. 28, 1969 which shows a so called "Pipe Stabber with Set Screws". However, the structure shown by that patent is for use with standard type tapered thread ends of drilling pipe or tubing. And, in addition it has the stabbing guide thereof attached by set screws on the upper end of a section of pipe being made up into a string thereof. Such arrangement and structure is clearly not applicable to the applicants invention. Also, as to any safety slip function, it would be quite impractical since the set screws would clearly not hold a string of pipe or tubing should the slips let go.

In addition, there is a U.S. Pat. No. 4,194,765 to Reddy, Mar. 25, 1980. However, that patent deals with a guide sleeve that helps line up and engage the ends of telescoping type tubing structure that slides longitudinally together in making connection of one tube to the next. It is not relevant to the type of tubing and connectors which are to be joined in accordance with the applicants invention.

BRIEF SUMMARY OF THE INVENTION

Briefly, the invention concerns a stabbing box and safety slip for use in making tubing connections during running of tubing into a well. The said tubing has flanged tips on end connectors that are adapted for abutting contact with clamping in order to join sections of the tubing together. The combination comprises a body member having one end adapted for clamping onto one of said flanged tips. The other end of the said body member has tapered guide means for receiving and guiding one of said end connectors into abutting contact with another, in said one end of the body member.

Again briefly, the invention concerns a stabbing box and safety slip for use in making tubing connections during running of tubing into a well. The said well has a well head opening for inserting said tubing therethrough, and the said tubing has flanged tips on end connectors adapted for abutting contact with clamping in order to join sections of tubing together. The combination comprises a cylindrical body member having a longitudinally split construction, and having one end adapted for clamping onto one of said flanged tips. It also comprises a removable clamp for holding said body member onto said one flanged tip. The said ends of the connectors and flanged tips are cylindrical and there is a tapered guide means for receiving and guiding one of said end connectors. It comprised two tapered sections joined by a cylindrical section. One of said tapered sections is for guiding said end connector to center said other flanged tip into alignment with said one clamped flange tip. The other of said tapered sections is for connecting said guide means cylindrical section to a lower cylindrical chamber extending up from said clamped flanged tip. The said lower chamber is for receiving and aligning a washer between the abutted ends of said flanged tips. The said flanged tips have a smaller outside diameter than the outside diameter of said connectors, and the said cylindrical body member has an outside diameter greater than said well head opening in order to prevent said tubing from falling into said well.

BRIEF DESCRIPTION OF THE DRAWINGS

The foregoing and other objects and benefits of the invention will be more fully set forth below in connection with the best mode contemplated by the inventor of carrying out the invention, and in connection with which there are illustrations provided in the drawings, wherein.

DESCRIPTION OF THE PREFERRED EMBODIMENT

When tubing of the type described in my afore mentioned copending application Ser. No. 510,485 filed July 5, 1983 is employed, it needs to have the end couplings aligned prior to the application of a clamp to hold them together. The couplers on the ends of such tubing have flanged tips and they are connected together in abutting relation with a washer in between. A clamp is applied to hold them securely together in alignment. In order to facilitate such connecting of two sections of tubing together, a stabbing box and safety slip structure according to this invention is of great assistance.

Figure 1:
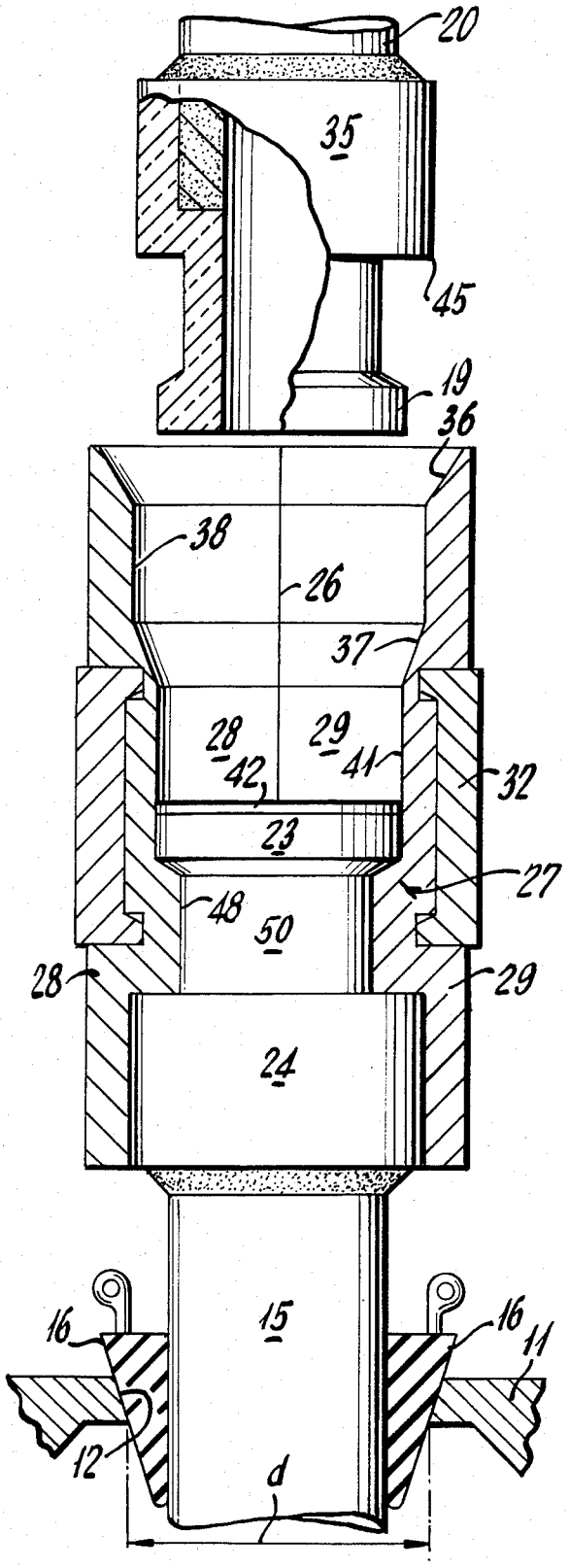
FIG. 1 shows a schematic elevation partly in longitudinal cross section and illustrating an embodiment of structure according to the invention.

With reference to the drawings and particularly to FIG. 1, there is shown a well head structure 11 that may be a rotary table or the like. There is a well head opening 12 which has a diameter d as indicated. During an operation for making up a string of tubing, there will be a tubing section 15 that extends into the well. This tubing section 15 and any additional string of tubing connected below is held in place at the well head by a plurality of slips 16. These so called slips are wedges that are placed into the opening 12 in the well head structure 11 around the tubing section 15 in order to apply friction against the tubing 15 to hold it up as a tubing connection is made. It may be noted that with tubing of the type to which this invention applies, the slips 16 are made of resiliant material in order to avoid damage to the tubing 15.

Slips in general are subject to "letting go", and that can result in the tubing string being lost down hole. However, by using a safety slip and stabbing box structure according to this invention, the possibility of such loss of tubing downhole during make up of a connection at the ends of tubing sections, is avoided.

It will be observed that tubing of the type to which a stabbing box and safety slip according to this invention applies, has flanged tips thereon. Thus, there is a flanged tip 19 on an upper tubing section 20 that is being placed into alignment for connection with another flanged tip 23 that is on an end connector 24 of the tubing section 15.

A stabbing box structure according to the invention is made up of a cylindrical body member 27 that has a longitudinally split construction (as indicated by a parting line 26 in FIG. 1) so that it is made up of two halves 28 and 29. There is a removable clamp 32 which holds the two halves 28 and 29 of the body member 27 together.

The inside contours of the body member 27 are made to match the flanged tip 23 of the connector 24. Consequently, when the body member 27 is clamped in place onto the connector 24 and its flanged tip 23, the tubing section 15 holds the body member 27 securely fastened to the upper end thereof. In this regard, it will be noted that the outside diameter of the body member 27 together with the clamp 32 is greater than the diameter d of the opening 12 in the well head structure 11. Therefore, should the slips 16 let go during an alignment procedure, the body member 27 would make contact with the well head structure 11 and prevent the tubing string from being lost downhole.

The illustrations show another end connector, e.g. a connector 35 which is attached on the lower end of the tubing section 20. It is shown suspended above, ready for guiding it into abutting relation with the other connector 24 that has the body member 27 clamped thereon. The guide means of the stabbing box, i.e. body member 27, is made up of two tapered sections 36 and 37 which are joined by a cylindrical section 38 in between. Also, there is a lower cylindrical chamber 41 that extends up above the flanged tip 23 of the lower connector 24 (which is being held clamped into the lower portion of body member 27). It may be noted that the chamber 41 acts to receive and align a washer 42 that is placed onto the annular face or surface of the flanged tip 23 prior to the insertion of the tubing section 20 (with its connector 35 and flange 19 at the tip thereof).

It is to be noted that the flanged tips 19 and 23 have smaller outside diameters than the outside diameters of the bodies of the corresponding connectors 35 and 24 respectively. Futhermore, the cylindrical section 38 in the guide means for the stabbing box is dimensioned so as to have a sliding fit for the body of a connector, such as connector 35. Also, there is a lower edge 45 of the connector 35 which will contact the tapered section 36 as tubing 20 is lowered into the stabbing box.

Figure 2:
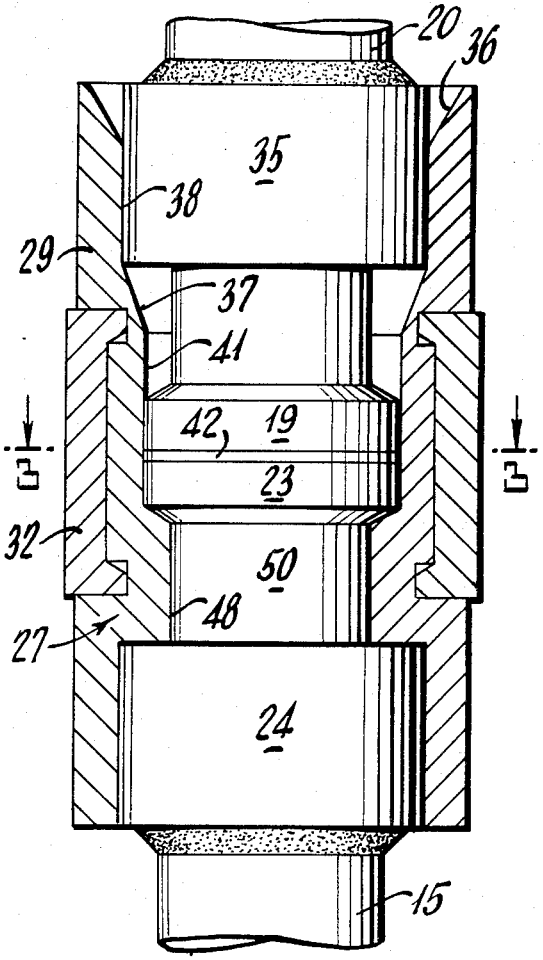
FIG. 2 is a longitudinal cross section like part of FIG. 1, showing the ends of two tubing connectors in place in the stabbing box structure.
Figure 3:
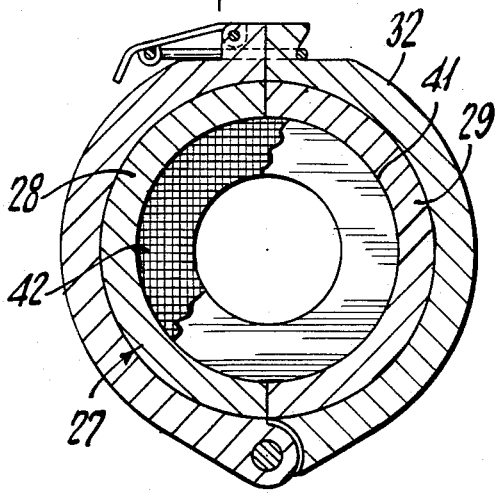
FIG. 3 is a transverse cross section taken along the lines 3—3 of FIG. 2 and looking in the direction of the arrows.

FIG. 2 illustrates the ends of tubing sections 20 and 15 after the upper section 20 has been lowered into place in abutting relation and into proper alignment prior to removal of the body member 27.

It may be noted that the procedure for using a stabbing box and safety slip according to this invention, involves the following steps. After a section of tubing, e.g. tubing section 15, has been placed into the well and supported by slips (such as the slips 16 illustrated), a stabbing box and safety slip such as the body member 27 is put in place on the connector 24. This is done by positioning the two split halves 28 and 29 around the connector 24 and its flanged tip 23. It will be noted that the lower portion of the body member 27 has a smaller diameter section 48 which fits snugly over a necked-in connecting part 50 of the connector 24 and underneath the flanged tip 23.

Next, the clamp 32 is applied and tightened, so as to hold the stabbing box structure in place ready for the positioning and alignment of another tubing section thereabove. It will be understood that, as already pointed out above, the stabbing box acts as a safety slip after it has been clamped into place. This is because of its dimensions which are greater than the opening 12 at the well head structure 11. Consequently, should the slips 16 let go during a connecting procedure, the stabbing box 27 will act as a safety slip to prevent the tubing 15 and any additional tubing string there beneath from falling into the well.

Next, another tubing section, e.g. section 20, is suspended from above into a position such as that illustrated in FIG. 1. Thus it is held above the opening at the top of the body member 27 which is formed by the upper tapered section 36. Then, as the tubing section 20 is lowered its connector 35 moves down into the guiding structure and the edges 45 of the connector 35 will come in contact with the tapered surface 36. Therefore the tubing 20 and its connector 35 will be guided into a centered or axial position relative to the lower tubing section 15 with its connector 24 and flanged tip 23. Such alignment or centering action takes place as the edges 45 of connector 35 reach the bottom of the tapered section 36 which is the top of the cylindrical section 38.

Next, the connector 35 will slide down within the cylindrical section 38 while the flanged tip 19 is being held centered and so out of contact with inside surfaces of the stabbing box 27 such as the lower tapered section 37. Consequently, any damage to the lower surface, or face of the flanged tip 19 will be avoided.

Finally, the parts will reach the relative position that are illustrated in FIG. 2. Thereafter, the clamp 32 will be removed from the stabbing box 27 and the stabbing box will also be removed by separating its split halves 28 and 29. Then, a clamp (not shown) would be applied to the flanged tips 19 and 23 with the washer 42 therebetween. That would be done in order to hold the two ends of tubing sections 20 and 15 securely together. It will be understood that the last mentioned clamp is not illustrated here but it has been shown and described in my aforementioned copending application Ser. No. 510,485 filed July 5, 1983.

It will be noted that the applicant has invented a meritorious stabbing box and safety slip combination which is particularly applicable to tubing sections that have coupling end members with flanged tips thereon. The stabbing box guiding structure is so constructed as to facilitate the matching alignment of the end connectors of tubing sections while at the same time avoiding any damaging contact which would mar the surface of the flanged elements of the tubing sections. In addition, the function of acting as a safety slip is important in case the slips holding a tubing string therebeneath should let go. The safety slip function would thus avoid a costly fishing operation to retrieve tubing from the hole.

While the foregoing description of a preferred embodiment has been made in considerable detail in accordance with the applicable statues, this is not to be taken as in any way limiting the invention but merely as being descriptive thereof.

I claim:

1. Stabbing box and safety slip for use in making tubing connections during running of tubing into a well, said tubing having flanged tips on end connectors, said end connectors being adapted for abutting contact prior to clamping in order to join sections of tubing together, said stabbing box and safety slip comprising a split body having one end adapted for clamping onto one of said end connectors and its flanged tip, the other end of said body member having tapered guide means for receiving and guiding another one of said end connectors and its flanged tip into abutting relation with said one connector in said one end of the body member.

2. Stabbing box and safety slip according to claim 1 wherein said split body comprises a longitudinally split construction, and said stabbing box and safety slip also comprises a removable clamp for holding said body member onto said one end connector and its flanged tip.

3. Stabbing box and safety slip according to claim 2, wherein said tapered guide means comprises plural tapered sections joined by an axially parallel section for guiding said other end connector and its flanged tip to center with said one connector and its flanged tip.

4. Stabbing box and safety slip according to claim 3, wherein said end connectors are cylindrical, and said flanged tips have a smaller outside diameter than the maximum outside diameter of said connectors.

5. Stabbing box and safety slip according to claim 4, wherein said body member is cylindrical.

6. Stabbing box and safety slip according to claim 5, wherein said well has a well head opening for inserting said tubing therethrough, and said split body has an outside diameter greater than said well head opening to prevent said tubing from falling into the well when said split body is clamped onto said one end connector.

7. Stabbing box and safety slip for use in making tubing connections during running of tubing into a well, said well having a well head opening for inserting said tubing therethrough, and said tubing having flanged tips on end connectors, said end connectors being adapted for abutting relation prior to clamping in order to join sections of tubing together, said stabbing box and safety slip comprising in combination a cylindrical body member having a longitudinally split construction and having one end adapted for clamping onto one of said end connectors and its flanged tip, a removable clamp for holding said body member onto said one end connector and its flanged tip, said end connectors and flanged tips being cylindrical, said cylindrical body member having tapered guide means at the other end for receiving and guiding another of said end connector and its flanged tip, said tapered guide means comprising two tapered sections joined by a cylindrical section, one of said tapered sections being for guiding said other end connector to center its flanged tip into alignment with said one clamped end connector and its flanged tip, the other of said tapered sections being for connecting said cylindrical section to a lower cylindrical chamber extending up from said one clamped end connector and its flange tip, said lower chamber being for receiving and aligning a washer between the ends of said flanged tips, said flanged tips having a smaller outside diameter than the maximum outside diameter of said connectors, and said cylindrical body member having an outside diameter greater than said well head opening to prevent said tubing from falling into said well when said body member is clamped onto said one end connector.

* * * * *